US007955127B2

(12) United States Patent
Sakamoto et al.

(10) Patent No.: US 7,955,127 B2
(45) Date of Patent: Jun. 7, 2011

(54) CONNECTOR

(75) Inventors: Nobuyuki Sakamoto, Makinohara (JP); Keiko Ishida, Makinohara (JP); Kazuki Zaitsu, Makinohara (JP); Yusaku Oki, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/452,403

(22) PCT Filed: May 26, 2008

(86) PCT No.: PCT/JP2008/060091

§ 371 (c)(1), (2), (4) Date: Dec. 29, 2009

(87) PCT Pub. No.: WO2009/008231

PCT Pub. Date: Jan. 15, 2009

(65) Prior Publication Data

US 2010/0136842 A1 Jun. 3, 2010

(30) Foreign Application Priority Data

Jul. 9, 2007 (JP) ..... 2007-179787

(51) Int. Cl.
*H01R 13/40* (2006.01)

(52) U.S. Cl. ..... 439/587

(58) Field of Classification Search ..... 439/587–589
See application file for complete search history.

(56) References Cited

U.S. PATENT DOCUMENTS

| | | | | |
|---|---|---|---|---|
| 5,518,415 | A | 5/1996 | Sano | |
| 7,381,090 | B2 * | 6/2008 | Sakamoto et al. | 439/587 |
| 7,422,458 | B2 * | 9/2008 | Arai | 439/274 |
| 2006/0240710 | A1 | 10/2006 | Kato et al. | |

FOREIGN PATENT DOCUMENTS

JP 05-152028 6/1993

OTHER PUBLICATIONS

International Search Report and Written Opinion dated Jul. 29, 2008 issued in International Application No. PCT/JP2008/060091.

* cited by examiner

*Primary Examiner* — Gary F. Paumen
(74) *Attorney, Agent, or Firm* — Edwards Angell Palmer & Dodge LLP

(57) ABSTRACT

A connector which can be made small is provided. The connector 1 includes: a connector housing 2 receiving terminal fittings 13 arranged in rows, the terminal fitting 13 attaching an electric wire 17 thereto; and a holding part 3 including a plurality of molded members 20 molded integrally with an outer periphery of the electric wires 17; and a packing 4 attached to an outer periphery of the holding part 3 and sealing up a space between the holding part 3 and the connector housing 2.

6 Claims, 11 Drawing Sheets

CONNECTOR

TECHNICAL FIELD

The present invention relates to a connector, which is used to connect electric wires and maintains a watertight characteristic between the electric wire and the connector.

BACKGROUND ART

A motor vehicle as a mobile unit mounts various electronic instruments. The motor vehicle mounts a wiring harness to transmit electric power and control signals to the electronic instruments. The wiring harness includes a plurality of electric wires and connectors. The electric wire is a so-called coated electric wire, which includes an electrically conductive core wire and an electrically insulating coating which coats the core wire.

As the connector described above, for example, a connector disclosed in Japanese Patent Application Laid-Open No. H5-152028 is used. The connector disclosed in Japanese Patent Application Laid-Open No. H5-152028 includes a connector housing, a mat seal and so on. The connector housing includes a tube-shaped outer case and an inner housing, which is received in and attached to the outer case. The inner housing receives terminal fittings attached to ends of electric wires.

The mat seal is made of resilient synthetic resin such as rubber and formed in a thick flat plate-shape. The mat seal is provided with a plurality of holes, through which the electric wires pass. The mat seal allows the electric wires to pass through the holes and is received in the outer housing, so that the mat seal maintains a watertight characteristic between the electric wires and outer housing, that is, between the electric wires and the connector housing.

The connector described above is assembled as follows. The outer housing and the inner housing are assembled to each other, the electric wires attached to the terminal fittings are allowed to pass through the respective holes of the mat seal, and the mat seal is press-fit into the outer housing. Thus, the connector having a structure described above is assembled and fit to a mating connector. As for thus assembled connector, the mat seal maintains a watertight characteristic between the electric wires and the outer housing, that is, between the electric wires and the connector housing so as to prevent liquid such as water from entering the connector housing along the electric wires.

DISCLOSURE OF THE INVENTION

Problems that the Invention is to Solve

The mat seal is press-fit into the outer housing and resiliently deformed in a direction of contraction thereof, so that the connector disclosed in Japanese Patent Application Laid-Open No. H5-152028 maintains a watertight characteristic between a plurality of the electric wires and the outer housing. Therefore, the connector disclosed in Japanese Patent Application Laid-Open No. H5-152028 requires that the mat seal is resiliently deformed to a certain extent so that the mat seal maintains a watertight characteristic between the electric wires and the mat seal.

Accordingly, as for the connector disclosed in Japanese Patent Application Laid-Open No. H5-152028, it is not possible to make a distance between the electric wires smaller than a distance, by which the mat seal can securely maintain a watertight characteristic between the electric wires and the mat seal. As a result, as for the connector disclosed in Japanese Patent Application Laid-Open No. H5-152028, it is difficult to make the distance between the electric wires smaller.

Therefore, it is an objective of the present invention to solve the problem described above and to provide a connector which maintains a watertight characteristic between the electric wire and the connector, wherein the connector can be made small.

Means of Solving the Problems

In order to solve the above problem and to attain the above objective, a connector according to the present invention is a connector including:

a connector housing receiving at least two terminal fittings arranged in rows, the terminal fitting attaching an electric wire thereto;

a holding part including a molded member molded integrally with an outer periphery of at least one said electric wire; and a sealing member attached to an outer periphery of the holding part and sealing up a space between the holding part and the connector housing.

As for the connector according to the present invention, since the holding part, which attaches the sealing member to the outer periphery thereof, is molded integrally with an outer periphery of at least one electric wire, therefore the holding part closely adhere to the electric wire, thereby maintaining a watertight characteristic therebetween. That is, a watertight characteristic between the holding part and the electric wire can be securely maintained even when a distance between the electric wires is made narrow, in comparison with a case in which a mat seal such as rubber for sealing with respect to the electric wire is used.

The connector is provided with a plurality of the molded members, the molded members are molded integrally with outer peripheries of a plurality of the electric wires, and the molded members are placed one upon another.

Since the molded members of the holding part are molded integrally with outer peripheries of a plurality of the electric wires, therefore a watertight characteristic between the molded members and a plurality of the electric wires can be securely maintained.

The holding part includes a molded layer molded integrally with a plurality of the molded members placed one upon another.

Since the molded layer of the holding part is molded integrally with a plurality of the molded members placed one upon another, so that a plurality of the molded members are integrally molded, therefore a plurality of the molded members adhere closely to one another, thereby maintaining a plurality of the molded members watertight to one another.

The sealing member includes:

an outer periphery attached part attached to outer peripheries of a plurality of the molded members placed one upon another; and sandwiched parts sandwiched between a plurality of the molded members placed one upon another.

Since the sealing member includes the sandwiched parts sandwiched between a plurality of the molded members placed one upon another, therefore a plurality of the molded members adhere closely to one another, thereby maintaining a plurality of the molded members watertight to one another.

The sealing member is formed when the space between the holding part and the connector housing is filled with synthetic resin on a condition that the holding part is received in the connector housing.

Since the sealing member is formed when a space between the holding part and the connector housing is filled with synthetic resin on a condition that the holding part is received in the connector housing, therefore a watertight characteristic between the sealing member and the connector housing can be maintained.

Effects of the Invention

With the construction of the present invention, the watertight characteristic between the holding part and the electric wire can be securely maintained even when a distance between the electric wires is made narrow, in comparison with a case in which a mat seal such as rubber for sealing with respect to the electric wire is used. Therefore, the connector can be made small.

With the construction of the present invention, since the molded members of the holding part are molded integrally with outer peripheries of a plurality of the electric wires, therefore a watertight characteristic between the molded members and a plurality of the electric wires can be securely maintained. Therefore, the watertight characteristic between the molded members and the electric wires can be securely maintained even when a distance between the electric wires is made narrow. Therefore, the connector can be made further small.

With the construction of the present invention, since the molded layer of the holding part is molded integrally with a plurality of the molded members placed one upon another, so that a plurality of the molded members are integrally molded, therefore a plurality of the molded members adhere closely to one another, thereby maintaining a plurality of the molded members watertight to one another. Therefore, liquid such as water can be prevented from entering the connector housing along the electric wires.

With the construction of the present invention, since the sealing member includes the sandwiched parts sandwiched between a plurality of the molded members placed one upon another, therefore a plurality of the is molded members adhere closely to one another, thereby maintaining a plurality of the molded members watertight to one another. Therefore, liquid such as water can be prevented from entering the connector housing along the electric wires.

With the construction of the present invention, since the sealing member is formed when a space between the holding part and the connector housing is filled with synthetic resin on a condition that the holding part is received in the connector housing, therefore a watertight characteristic between the sealing member and the connector housing can be maintained. Therefore, liquid such as water can be prevented from entering the connector housing along the electric wires.

ABBREVIATION NUMERALS

Figure 1:
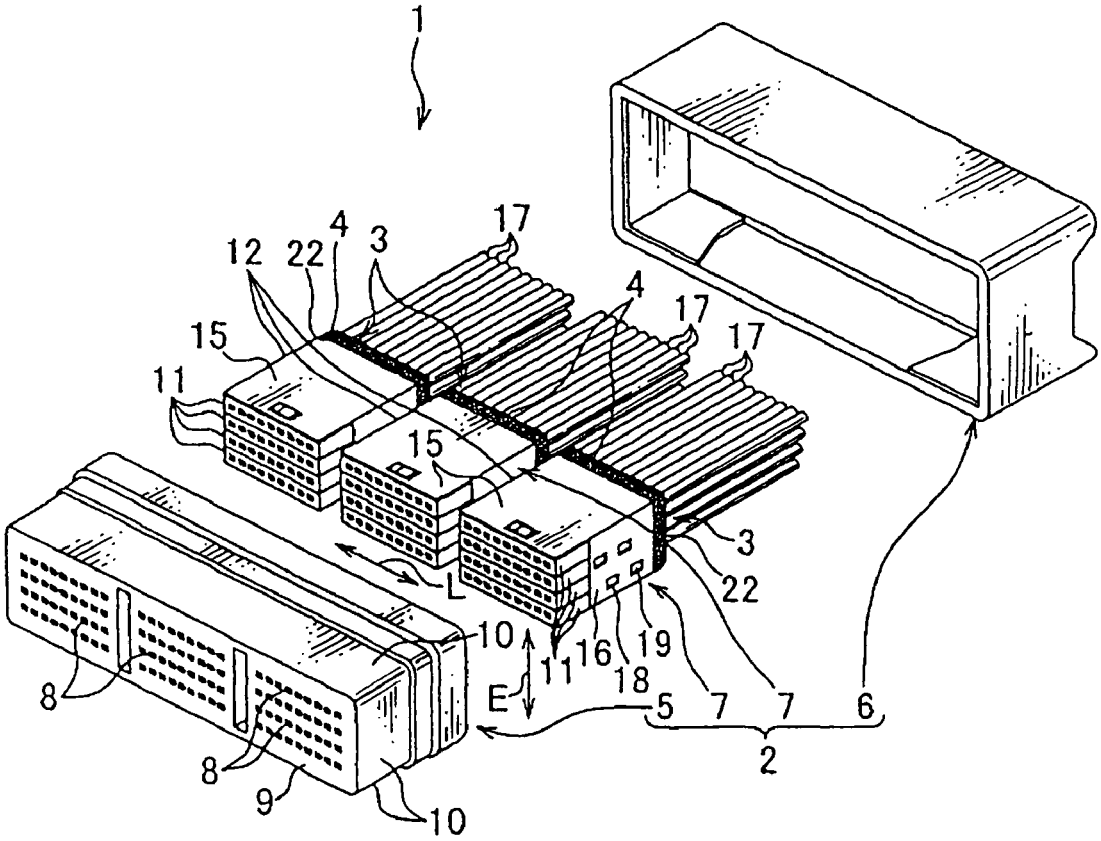
FIG. 1 An exploded perspective view of a connector according to the first preferred embodiment of the present invention FIG. 2 An exploded perspective view of a connector block and so on of the connector shown in FIG. 1

1: connector
2: connector housing
3: holding part
4: packing (sealing member)
13: terminal fitting
17: electric wire
20: molded member
21: molded layer
22: outer periphery attached part
23: O-ring (sealing member)
24: sandwiched part
27: sealing member

BEST MODE FOR CARRYING OUT THE INVENTION

In the following, a connector according to the first preferred embodiment of the present invention will be explained with reference to FIGS. 1-7.

Figure 2:
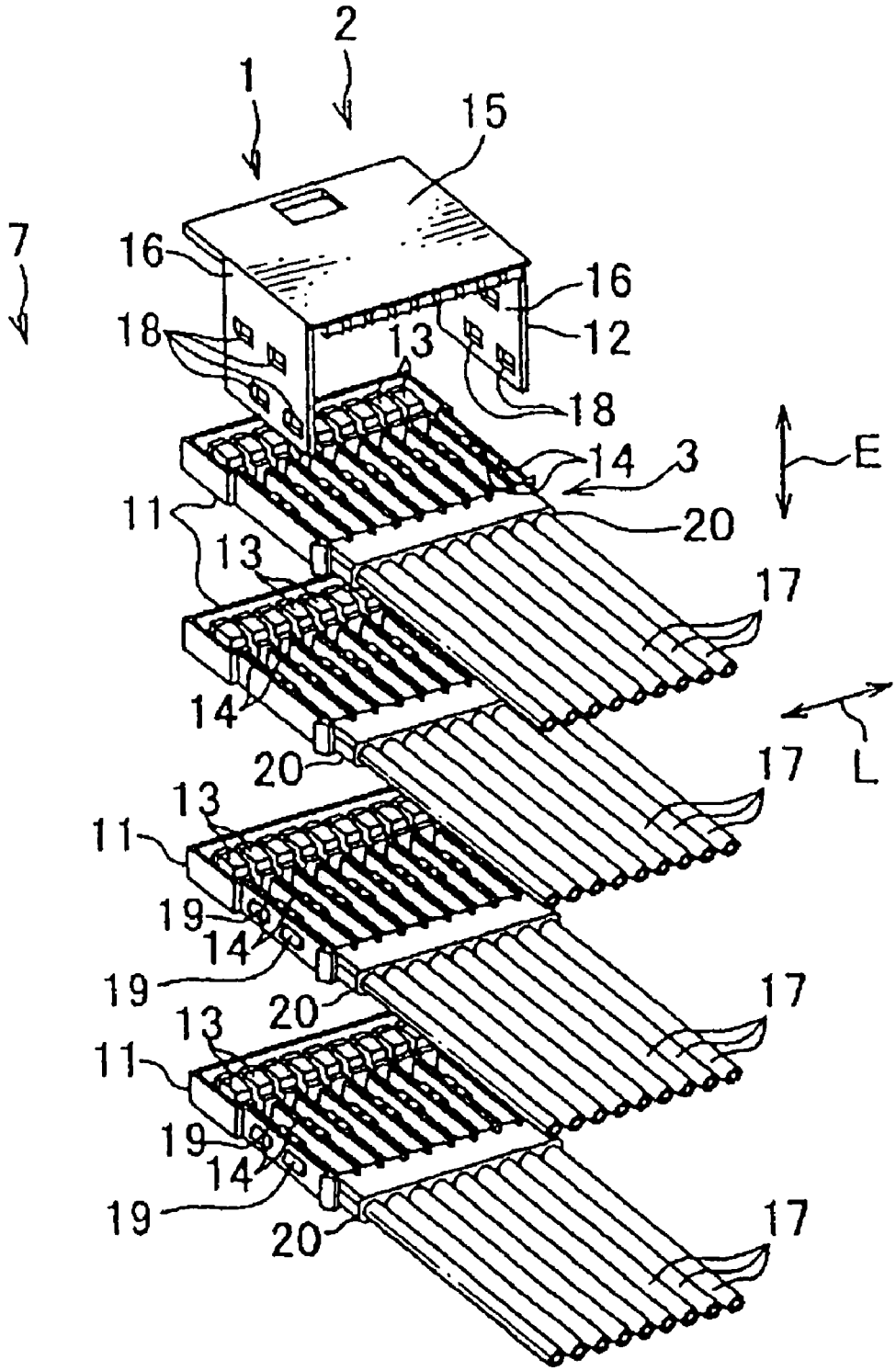

As shown in FIGS. 1 and 2, a connector 1 includes a connector housing 2, a holding part 3, and a plurality of packings 4 (corresponding to the sealing member). The connector housing 2 includes a housing body 5, an outer case 6, and a plurality of connector blocks 7.

The housing body 5 is made of electrically insulating synthetic resin and formed in a tube-shape. The housing body 5 includes; a facing wall 9 having a plurality of holes 8 which allow male tabs of male terminals of a mating connector, to which the connector 1 fits, to pass therethrough; and a plurality of peripheral walls 10 rising up from an outer edge of the facing wall 9. A space inside the housing body 5 is partitioned into the plural (for example, three in an example shown in the figure).

The outer case 6 is made of electrically insulating synthetic resin and formed in a tube-shape. The outer case 6 is fixed to the housing body 5 with receiving the housing body 5 and the connector blocks 7 therein.

In an example shown in the figure, three connector blocks 7 are provided. As shown in FIGS. 1 and 2, the connector block 7 includes a plurality of plate-shaped housings 11 and a cover member 12. In an example shown in the figure, the connector block 7 includes four plate-shaped housings 11.

The plate-shaped housing 11 is made of electrically insulating synthetic resin and formed in a flat plate-shape. The plate-shaped housing 11 is provided with a plurality of terminal receiving grooves 14 receiving terminal fittings 13 (shown in FIG. 2) attached to ends of electric wires 17. A plurality of the terminal receiving grooves 14 are formed straight denting from an outer surface of the plate-shaped housing 11 and arranged in parallel to each other. A plurality of the terminal receiving grooves 14 are arranged along a direction of an arrow L shown in FIG. 2.

A plurality of the plate-shaped housings 11 are placed one upon another along a direction of an arrow E crossing (crossing at right angles in an example shown in the figure) the direction of the arrow L. Each plate-shaped housing 11 receives the terminal fittings 13 lined up along the direction of an arrow L and a plurality of the plate-shaped housings 11 are placed one upon another along the direction of an arrow E, so that the connector block 7, that is, the connector housing 2 receives the terminal fittings 13 lined up in the directions of the arrows L and E, that is, in the directions crossing (or crossing at right angles) each other.

The cover member 12 is made of electrically insulating synthetic resin and formed in a C-shape. The cover member 12 includes a flat ceiling wall 15 and rising-up walls 16 rising up from outer edges of the ceiling wall 15, the outer edges being situated oppositely to each other. The ceiling wall 15 is placed on the plate-shaped housing 11 so as to cover the terminal receiving groove 14 of one plate-shaped housing 11 located uppermost in FIG. 12 among a plurality of the plate-shaped housings 11 and a plurality of the plate-shaped housings 11 are positioned between a pair of the rising-up walls 16, so that the cover member 12 is fixed to the plate-shaped housings 11. At that time, a locking projection 19 formed on the plate-shaped housing 11 engages with a hole 18 of the rising-up wall 16, so that the cover member 12 and the plate-shaped housings 11 are fixed to one another.

Thus, the plate-shaped housings 11, each of which receives the terminal fitting 13 attaching the electric wire 17 in the terminal receiving groove 14, are placed one upon another, the cover member 12 covers the plate-shaped housings 11, and the cover member 12 and the plate-shaped housings 11 are fixed to one another, so that the connector block 7 is assembled.

Figure 5:
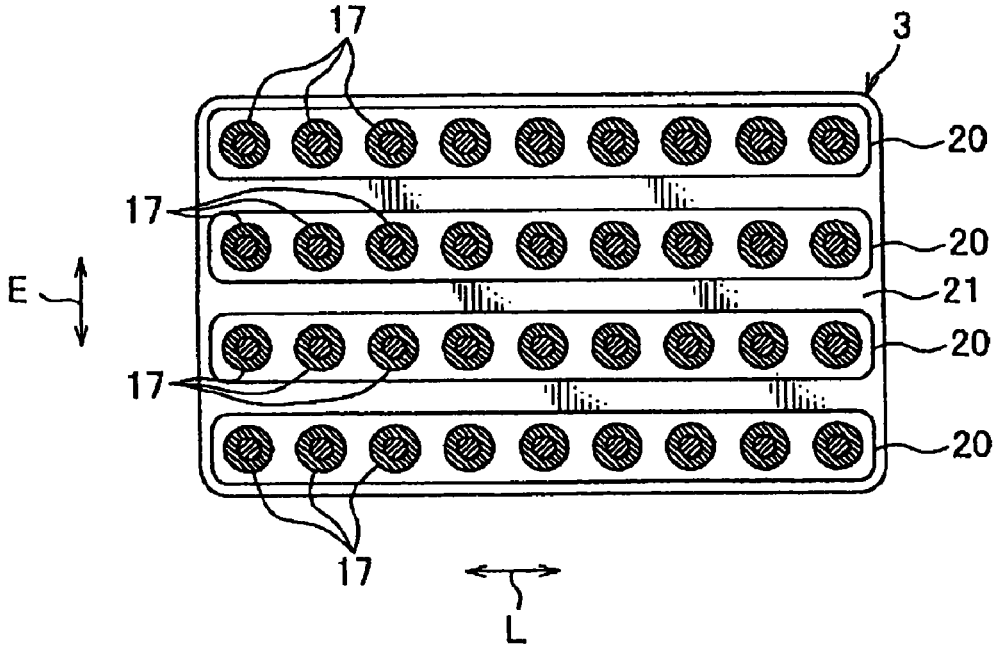
FIG. 5 A cross sectional view taken along a V-V line in FIG. 4

One holding part 3 is provided corresponding to one connector block 7. That is, in an example shown in the figure, three holding parts 3 are provided. As shown in FIG. 5, the holding part 3 includes a plurality of the molded members 20 and the molded layer 21, each of which is made of an electrically insulating hard (hardly resiliently deformed) synthetic resin. In an example shown in the figure, the holding part 3 includes four molded members 20.

Each molded member 20 corresponds to one plate-shaped housing 11. Each molded member 20 is formed in a bar-shape in the longitudinal direction, which is the direction of the arrow L. The molded member 20 is formed (molded) integrally with the outer periphery of all the electric wires 17 attached to the terminal fittings 13 received in the corresponding plate-shaped housing 11. Therefore, the electric wire 17 penetrates through the molded member 20, wherein a part of the electric wire 17 is embedded in the molded member 20.

The molded member 20 is arranged on the electric wire 17 near the plate-shaped housing 11, that is, on the plate-shaped housing 11 at the central side of the electric wire 17. The molded member 20 is arranged coming in contact with the plate-shaped housing 11. Plasticized synthetic resin fills the outer periphery of a plurality of the electric wires 17 by insert molding or the like and the synthetic resin is solidified, so that the molded member 20 is obtained. When the plate-shaped housings 11 are placed one upon another along the direction of the arrow E, the molded members 20 are placed on upon another being spaced from each other along the direction of the arrow E.

The molded layer 21 is formed between the molded members 20 placed one upon another and on the outer periphery of the molded members 20 so as to be formed integrally with a plurality of the molded members 20. The molded layer 21 is made of the same synthetic resin as that of the molded member 21. Plasticized synthetic resin fills between the molded members 20 and on the outer periphery of the molded members 20 by insert molding or the like and the synthetic resin is solidified, so that the molded layer 21 is obtained.

Thus, a plurality of the molded members 20 and the molded layer 21, that is, the holding part 3 are formed in one piece. Thus, the molded members 20 are formed integrally with the outer periphery of the electric wires 17, so that the holding part 3 is formed integrally with the outer periphery of the electric wires 17. The molded members 20 are formed integrally with the outer periphery of a plurality of the electric wires 17, a plurality of the molded members 20 are placed one upon another, and the molded layer 21 is integrally formed with between the molded members 20 and on the outer periphery of the molded members 20, so that the holding part 3 holds the distance among a plurality of the electric wires 17. Further, the molded members 20 are formed integrally with the outer periphery of a plurality of the electric wires 17 and the molded layer 21 is formed integrally with a plurality of the molded members 20, so that a watertight characteristic between the holding part 3 and the electric wires 17 is maintained.

Figure 6:
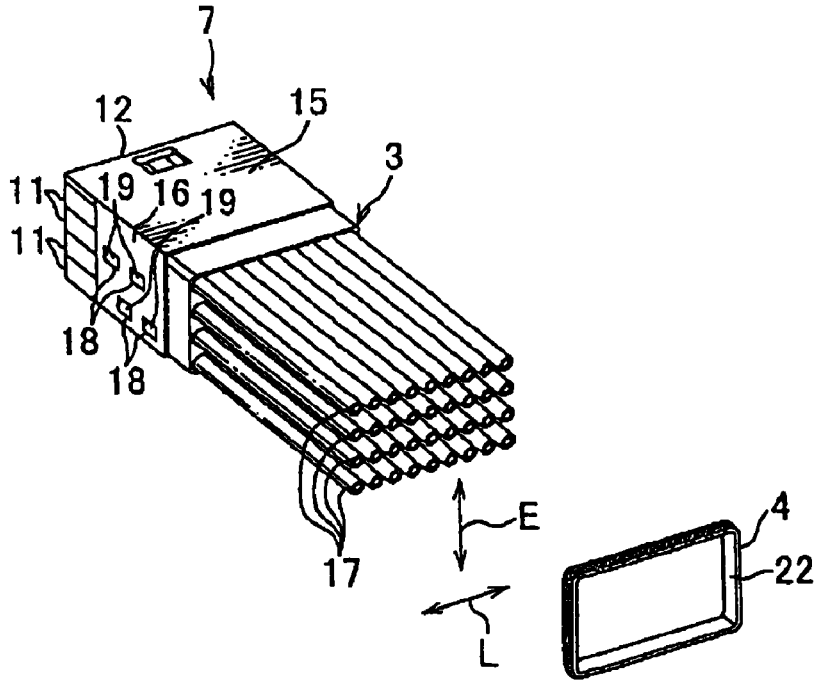
FIG. 6 A perspective view illustrating a state when a packing approaches a holding part shown in FIG. 4

The packing 4 is made of resilient material such as rubber. One packing 4 corresponds to one connector block 7. That is, in an example shown in the figure, three packings 4 are provided. As shown in FIG. 6, the packing 4 includes an outer periphery attached part 22 formed in a frame-shape. The holding part 3 is allowed to pass through the outer periphery attached part 22 of the packing 4, so that the outer periphery attached part 22 is attached to the outer periphery of the holding part 3, that is, to the outer periphery of a plurality of the molded members 20.

When the connector block 7 is attached to the outer case 6, the packing 4 together with the holding part 3 is press-fit into the outer case 6 so as to be attached to the connector housing 2. The packing 4 closely adheres to both of an outer peripheral surface of the holding part 3 and an inner surface of the outer case 6 so as to maintain a watertight characteristic between the holding part 3 and the outer case 6, thereby maintaining a watertight characteristic between the holding part 3 and the connector housing 2.

As for the connector 1 described above, first, the connector block 7 is assembled and the holding part 3 and the packing 4 are assembled into the connector block 7. The terminal fitting 13 with the electric wire 17 is press-fit into the terminal receiving groove 14 of the plate-shaped housing 11. Then, the terminal fitting 13 with the electric wire 17 is attached to the plate-shaped housing 11.

Then, the molded member 20 is formed integrally to the outer periphery of the electric wire 17 attached to the terminal fitting 13 received in the plate-shaped housing 11. Thereafter, a plurality of the plate-shaped housings 11 are placed one upon another, the plate-shaped housing 11 is sandwiched between the rising-up walls 16 of the cover member 12, and the ceiling wall 15 is placed thereon.

Figure 3:
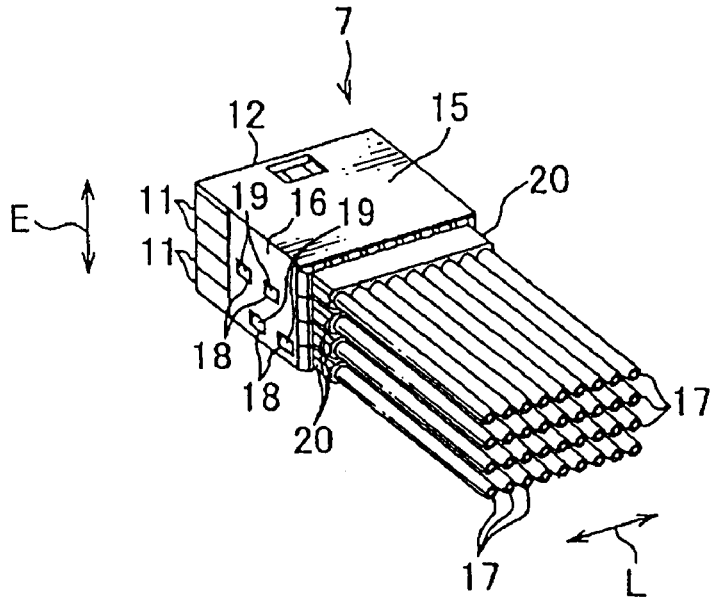
FIG. 3 A perspective view illustrating a state when a cover member and a plate-shaped housing of the connector block shown in FIG. 2 are assembled to each other FIG. 4 A perspective view illustrating a state when a molded layer is formed integrally with molded members shown in FIG. 3
Figure 4:
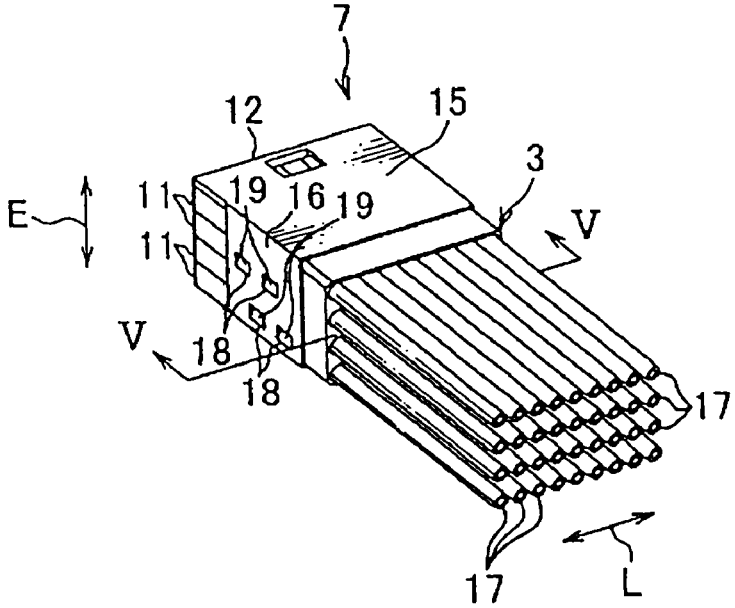

Then, the plate-shaped housings 11 and the cover member 12 are pressed in a direction approaching each other, so that the locking projection 19 of the plate-shaped housing 11 engages with a hole of the cover member 12, and as shown in FIG. 3, the plate-shaped housings 11 and the cover member 12 are fixed to one another, thereby assembling the connector blocks 7. Then, the synthetic resin fills a space between the molded members 20 placed one upon another and the outer periphery of the molded members 20, and as shown in FIGS. 4 and 5, the molded layer 21 is formed, so that a plurality of the molded members 20 and the molded layer 21 are formed in one piece.

Figure 7:
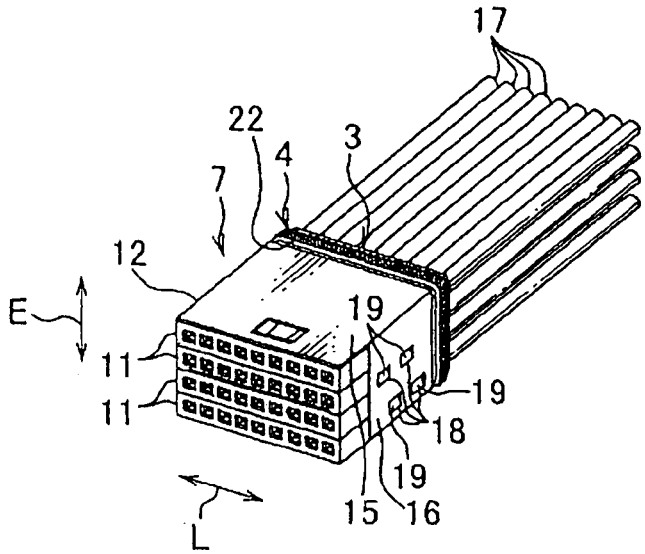
FIG. 7 A perspective view illustrating a state when the packing is attached to the holding part shown in FIG. 6

Thereafter, as shown in FIG. 6, the packing 4 is allowed to approach the connector block 7 from the central side of the electric wire 17, and as shown in FIG. 7, the packing 4 is attached to the molded layer 20, that is, to the outer periphery of the holding part 3. Thus, the connector block 7 is assembled, and the holding part 3 and the packing 4 are attached to the connector block 7.

After the connector block 7 is inserted into the housing body 5, the connector block 7, the holding part 3 and the packing 4 are press-fit into the outer case 6 per the housing body 5. Then, the outer case 6 and the housing body 5 are engaged with each other, so that the packing 4 maintains a watertight characteristic between the packing 4 and an inner surface of the outer case 6, thereby assembling the connector 1.

The connector 1 assembled as described above fits to a mating connector, thereby constructing a wiring harness to be mounted on a motor vehicle and so on.

According to the preferred embodiment described above, since the holding part 3, to the outer periphery of which the packing 4 is attached, is formed integrally with the outer periphery of the electric wires 17, therefore the holding part 3 closely adheres to the electric wires 17, thereby maintaining a watertight characteristic therebetween. Therefore, a watertight characteristic between the holding part 3 and the electric wires 17 can be securely maintained even when a distance between the electric wires 17 is made narrow, in comparison with a case in which a mat seal such as rubber for sealing with respect to the electric wire 17 is used. Accordingly, the connector 1 can be made small.

Since the molded layer 20 of the holding part 3 is molded integrally with the outer periphery of a plurality of the electric wires 17, therefore a watertight characteristic between the molded layer 20 and a plurality of the electric wires 17 can be maintained. Further, since the molded layer 20 of the holding part 3 is molded integrally with the outer periphery of a plurality of the electric wires 17, therefore a watertight characteristic between the molded layer 20 and a plurality of the electric wires 17 can be maintained even when a distance between the electric wires 17 is made narrow. Accordingly, the connector 1 can be made small.

Since the molded layer 21 of the holding part 3 is molded integrally with a plurality of the molded members 20 placed one upon another, so that a plurality of the molded members 20 are integrally molded, therefore a plurality of the molded members 20 adhere closely to one another, thereby maintaining a plurality of the molded members 20 watertight to one another. Therefore, liquid such as water can be prevented from entering the connector housing 2 along the electric wires 17.

Figure 8A:
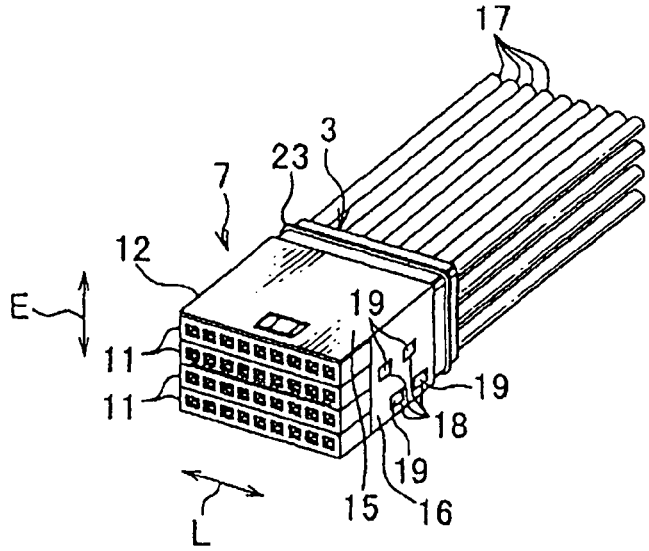
FIG. 8A A perspective view illustrating a modified example of the connector block and so on shown in FIG. 7
Figure 8B:
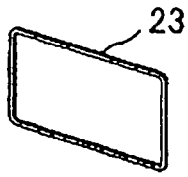
FIG. 8B A perspective view illustrating an O-ring shown in FIG. 8A

In the preferred embodiment described above, the packing 4 is used as the sealing member. However, in the present invention, as shown in FIGS. 8A and 8B, instead of the packing 4, an O-ring 23 may be used as the sealing member. Such an O-ring 23 is made of resilient synthetic resin such as rubber and formed in a frame-shape.

In the following, a connector according to the second preferred embodiment of the present invention will be explained with reference to FIGS. 9-12.

Figure 9:
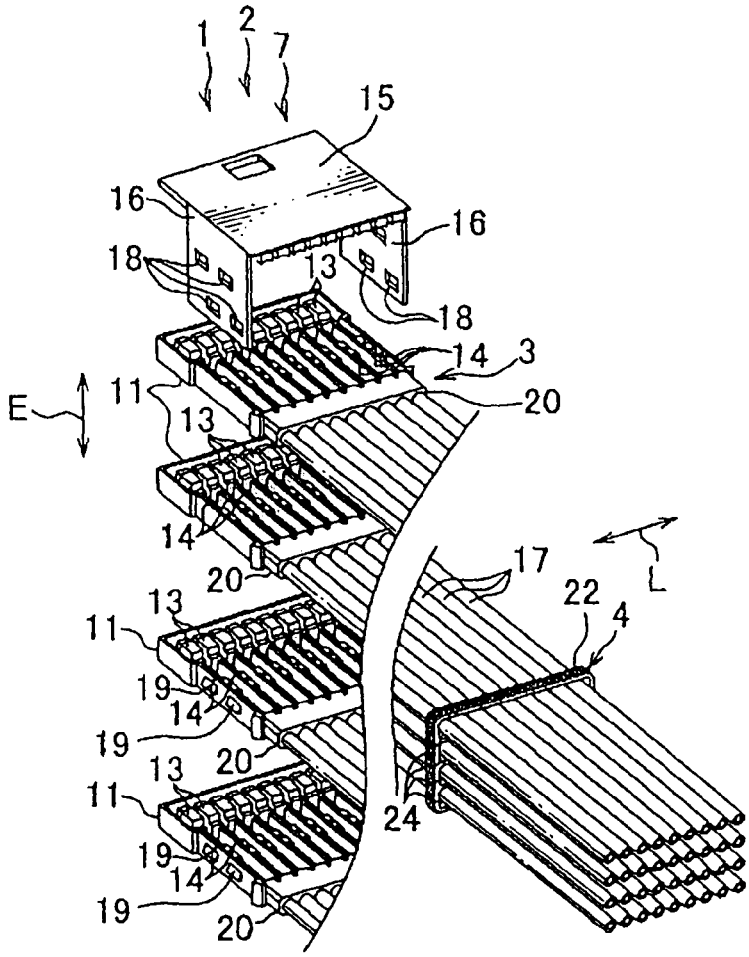
FIG. 9 An exploded perspective view of a connector block of a connector according to the second preferred embodiment of the present invention FIG. 10 A perspective view illustrating a packing of the connector shown in FIG. 9
Figure 10:
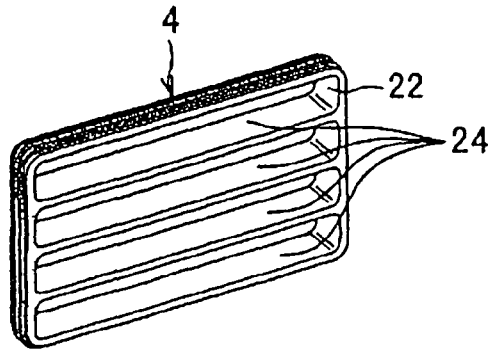

In the second preferred embodiment, the holding part 3 is not provided with the molded layer 21 as in the first preferred embodiment and instead, the packing 4 is integrally provided with sandwiched parts 24. As shown in FIGS. 9 and 10, the packing 4 of the second preferred embodiment is integrally provided with a plurality of sandwiched parts 24 in addition to the outer periphery attached part 22. In an example shown in the figure, three sandwiched parts 24 are provided. The sandwiched parts 24, each are formed in a flat-plate shape and are arranged being spaced from each other in parallel to each other. The sandwiched parts 24 are sandwiched between the respective molded members 20 placed one upon another so as to maintain a watertight characteristic between the molded members 20 and the sandwiched parts 24. The outer periphery attached part 22 of the packing 4 of the second preferred embodiment is attached to an outer periphery of a plurality of the molded members 20 placed one upon another.

The packing 4 maintains a watertight characteristic between the molded members 20 when the sandwiched parts 24 are placed one upon another. The outer periphery attached part 22 maintains a watertight characteristic between the molded members 20 and the outer case 6, that is, between the holding part 3 and the connector housing 2.

Figure 11:
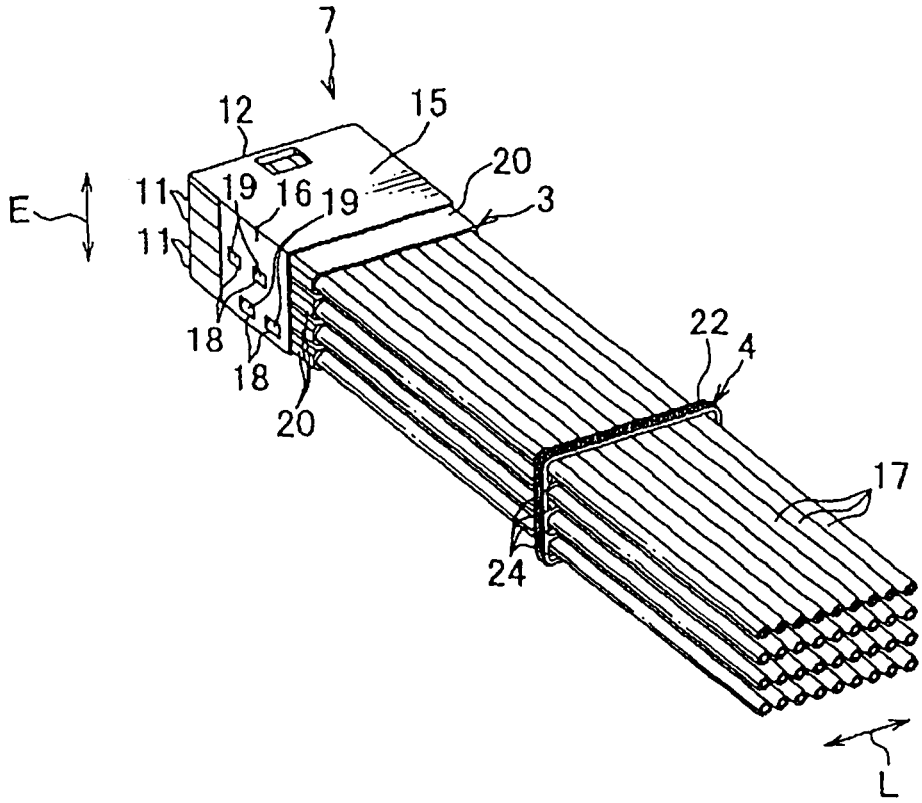
FIG. 11 A perspective view illustrating a state when a packing approaches a holding part shown in FIG. 9
Figure 12:
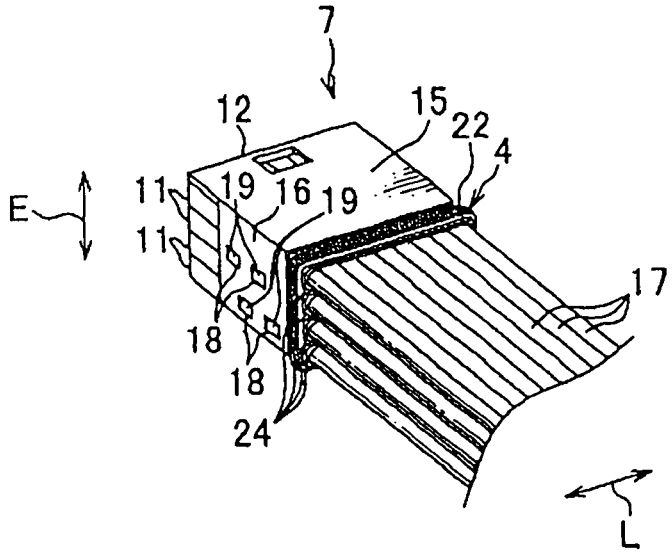
FIG. 12 A perspective view illustrating a state when the packing is attached to the holding part shown in FIG. 11

As shown in FIG. 11, a plurality of the plate-shaped housings 11 and the cover member 12 are assembled to each other, then the packing 4, which allows the electric wires 17 to pass through between the sandwiched parts 24 and between the sandwiched part 24 and the outer periphery attached part 22, is allowed to approach the connector block 7, thereafter as shown in FIG. 12, the sandwiched parts 24 of the packing 4 are sandwiched between the respective molded parts 20 and then, the outer periphery attached part 22 is attached to the outer periphery of the molded members 20, thereby the connector block 7 is assembled. Then, the connector blocks 7 are attached to the housing body 5 and the outer case 6, thereby the connector 1 is assembled.

According to the second preferred embodiment, since the molded members 20 of the holding part 3, to the outer periphery of which the packing 4 is attached, is formed integrally with the outer periphery of the electric wires 17, therefore the holding part 3 closely adheres to the electric wires 17, thereby maintaining a watertight characteristic therebetween. Therefore, a watertight characteristic between the holding part 3 and the electric wires 17 can be securely maintained even when a distance between the electric wires 17 is made narrow, in comparison with a case in which a mat seal such as rubber for sealing with respect to the electric wire 17 is used. Accordingly, the connector 1 can be made small.

Since the packing 4 as the sealing member is provided with the sandwiched parts 24 sandwiched between the molded members 20, therefore a plurality of the molded members 20 adhere closely to one another, thereby maintaining a plurality of the molded members 20 watertight to one another. Therefore, liquid such as water can be prevented from entering the connector housing 2 along the electric wires 17.

In the following, a connector according to the third preferred embodiment of the present invention will be explained with reference to FIGS. 13-20.

Figure 13:
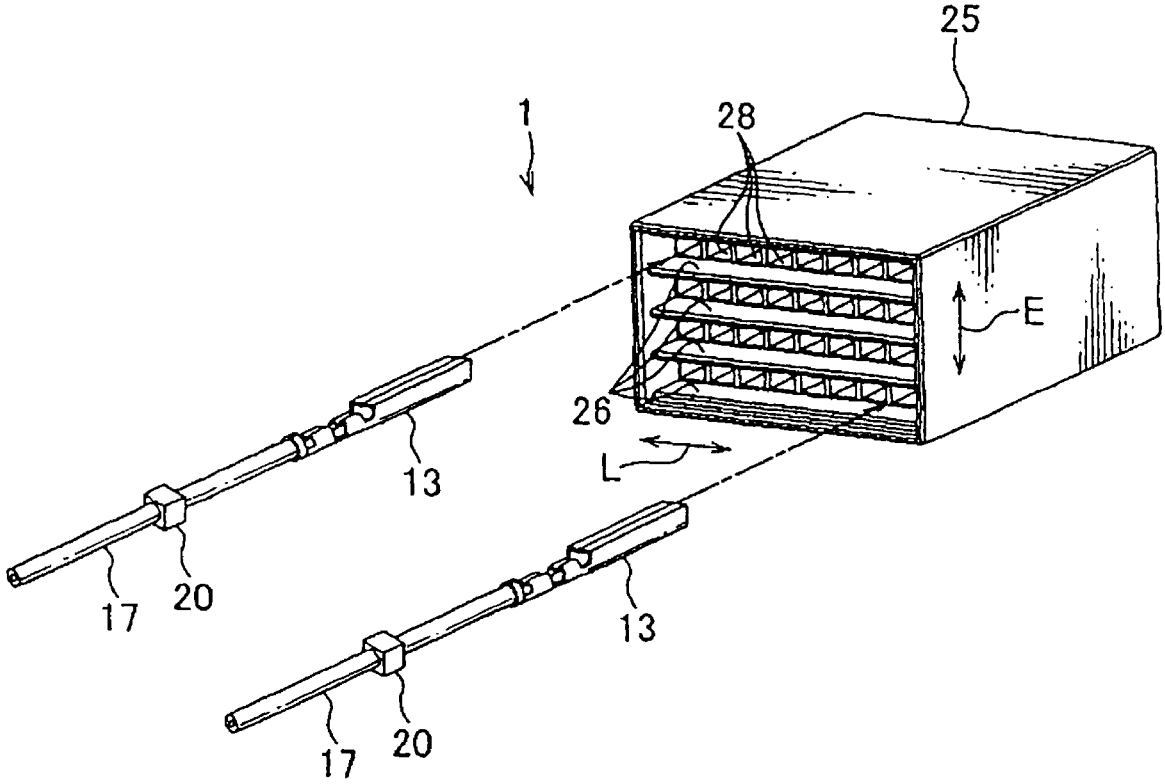
FIG. 13 An exploded perspective view of a connector according to the third preferred embodiment of the present invention FIG. 14 A perspective view illustrating a process when a terminal fitting is being inserted into a housing shown in FIG. 13

In the third preferred embodiment, as shown in FIG. 13, the connector housing 2 includes a single housing 25. The housing 25 is formed in a tube-shape as a whole and provided with a plurality of terminal receiving chambers 28 arranged parallel to each other. Each terminal receiving chamber 28 is a straight extending hole (space), both ends of which are opened. The terminal receiving chambers 28 are arranged parallel to each other along a direction of an arrow L shown in FIG. 13. The terminal receiving chamber 28 receives a terminal fitting 13 attached to an end of the electric wire 17. This side in FIG. 13 of the terminal receiving chamber 28 is provided with a communicating part 26 which communicates the terminal receiving chambers 28 to each other.

In the preferred embodiment, the holding part 3 includes the molded members 20 formed integrally with an outer periphery of respective ends of the electric wires 17. In an example shown in the figure, an external form of the molded member 20 is formed in a cubic shape. The molded member 20 is received in the communicating part 26 when the terminal fitting 13 attached to the electric wire 17 is received in the terminal receiving chamber 28.

Further, in the preferred embodiment, the terminal fitting 13 is received in the terminal receiving chamber 28 and the molded member 20 is received in the communicating part 26, thereafter resilient synthetic resin fills a space between the molded member 20 and the housing 25, that is, between the holding part 3 and the connector housing 2, so that a sealing member 27 is formed, that is, the sealing member 27 is attached to an outer periphery of the molded member 20 of the holding part 3.

Figure 14:
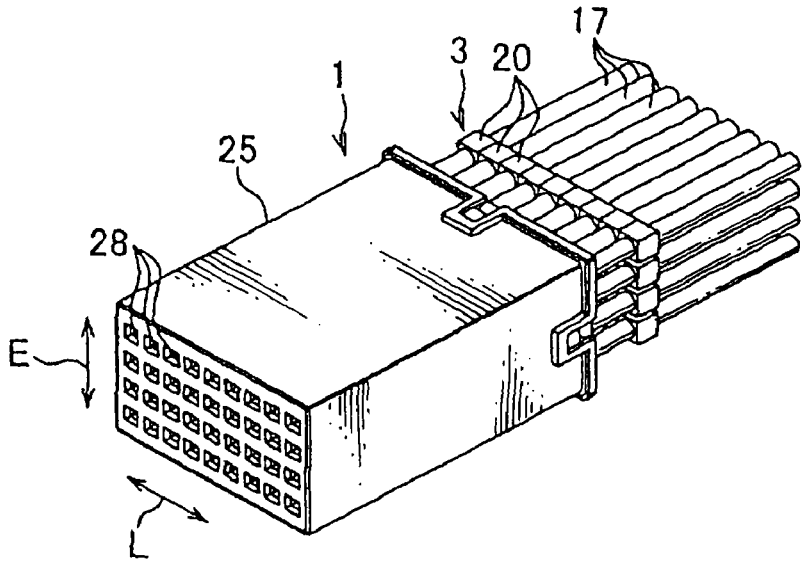
Figure 15:
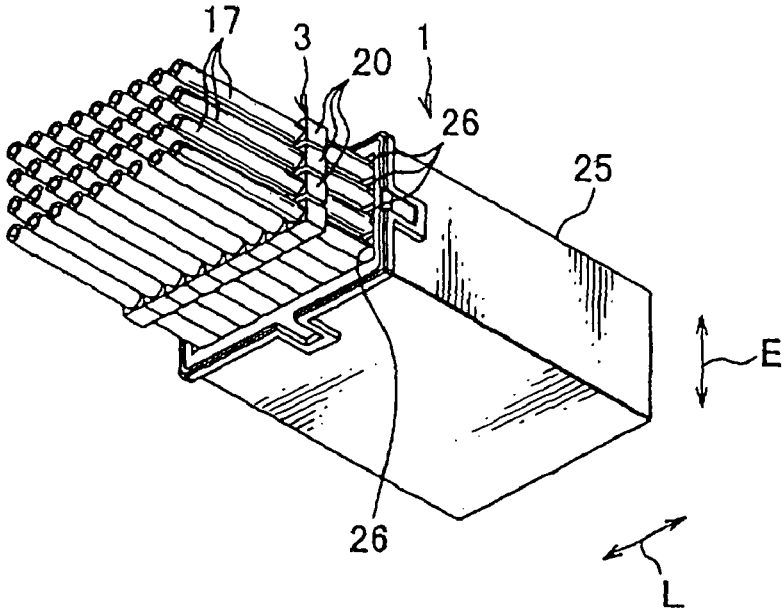
FIG. 15 A perspective view, viewed from the rear, of the housing shown in FIG. 14
Figure 16:
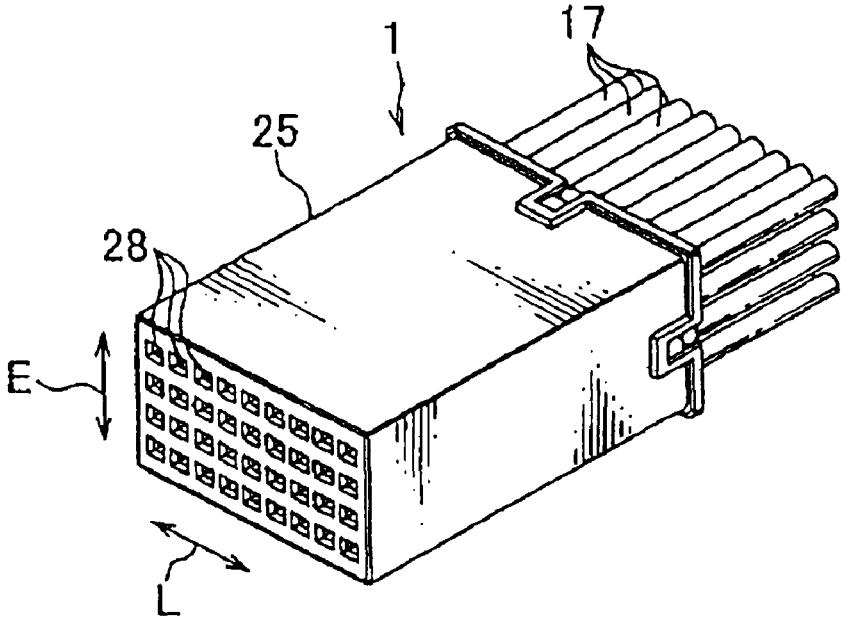
FIG. 16 A perspective view illustrating a state when the terminal fitting is inserted in the housing shown in FIG. 13
Figure 17:
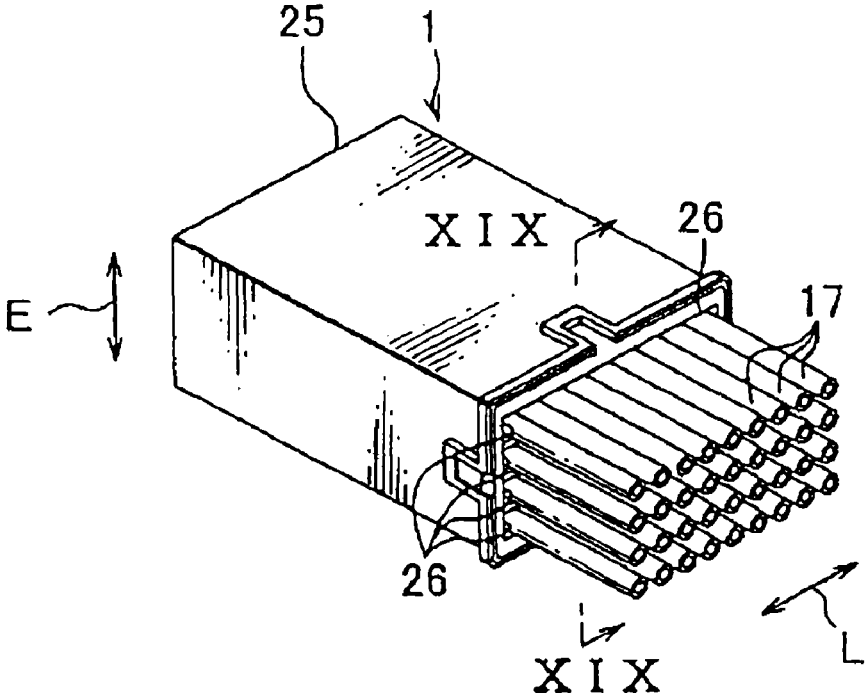
FIG. 17 A perspective view, viewed from the rear, of the housing shown in FIG. 16
Figure 18:
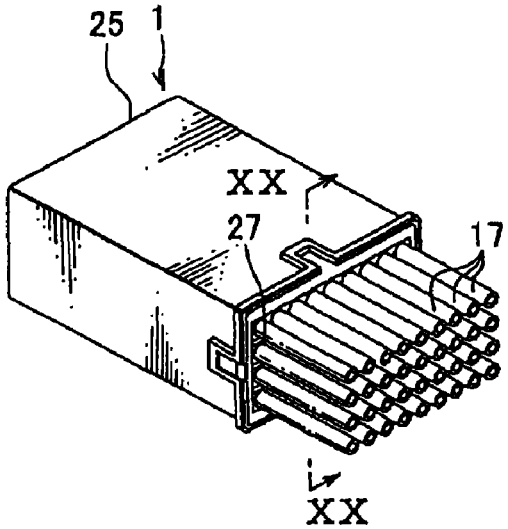
FIG. 18 A perspective view, viewed from the rear, illustrating a state when a sealing member is formed between the housing shown in FIG. 17 and the molded members FIG. 19 A cross sectional view taken along a XIX-XIX line in FIG. 17
Figure 19:
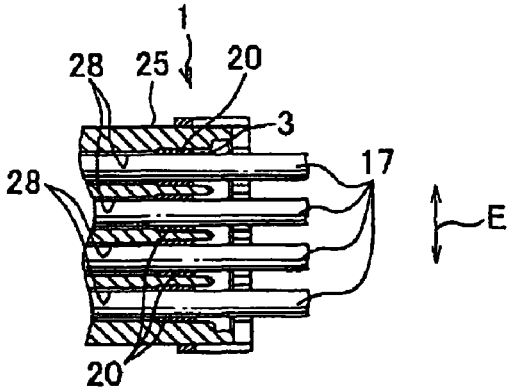
Figure 20:
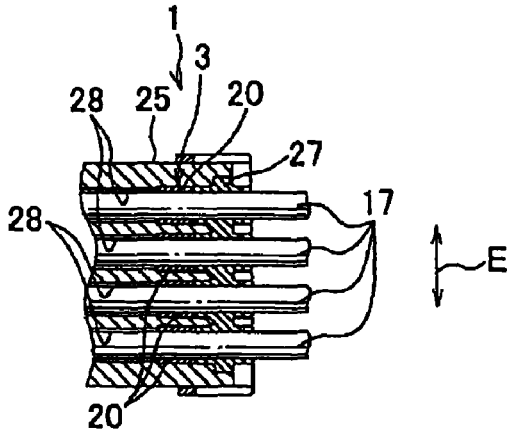
FIG. 20 A cross sectional view taken along a XX-XX line in FIG. 18

After the molded members 20 are integrally formed with an outer periphery of the electric wires 17, which attach the respective terminal fittings thereto, as shown in FIGS. 14 and 15, the terminal fittings 13 are inserted into the respective terminal receiving chambers 28. Then, as shown in FIGS. 16, 17 and 19, on a condition that each molded member 20 is received in the communicating part 26 (that is, on a condition that the holding part 3 is received in the connector housing 2), as shown in FIGS. 18 and 20, resilient synthetic resin fills the communicating part 26, that is, fills a space between the holding part 3 and the connector housing 2, so that the sealing member 27 is formed on (i.e., attached to) the periphery of the molded members 20, that is, on the periphery of the holding part 3, thereby the connector 1 is assembled.

According to the third preferred embodiment, since the molded members 20 of the holding part 3, to the outer periphery of which the sealing member 27 is attached, is formed integrally with the outer periphery of the electric wires 17, therefore the holding part 3 closely adheres to the electric wires 17, thereby maintaining a watertight characteristic therebetween. Therefore, a watertight characteristic between the holding part 3 and the electric wires 17 can be securely maintained even when a distance between the electric wires 17 is made narrow, in comparison with a case in which a mat seal such as rubber for sealing with respect to the electric wire 17 is used. Accordingly, the connector 1 can be made small.

Further, since a space between the holding part 3 and the connector housing 2 is filled with the synthetic resin on a condition that the molded members 20 is received in the connector housing 2, that is, on a condition that the holding part 3 is received in the connector housing 2, so that the sealing member 27 is formed, therefore a watertight characteristic between the sealing member 27 and the connector housing 2 can be maintained. Therefore, liquid such as water can be prevented from entering the connector housing 2 along the electric wires 17.

Thus, in the present invention, the holding part is integrally formed with the outer periphery of at least one electric wire 17. In the connector housing 11, the terminal fittings 13 may be arranged in any form so as to be received. That is, the molded member 20 may be formed in any form and the molded members 20 may be placed one upon another in any form. At least two terminal fittings 13 may be arranged and received in the connector housing 2.

In the preferred embodiment described above, a plurality of the molded members 20 are provided. However, in the present invention, only one molded member 20 may be provided. That is, all of the electric wires 17 may be bundled up together and a molded member 20 may be formed integrally with the outer periphery of such a bundled-up electric wires 17.

The aforementioned preferred embodiments are described to aid in understanding the present invention and variations may be made by one skilled in the art without departing from the spirit and scope of the present invention.

The invention claimed is:

1. A connector comprising:

a connector housing receiving at least two terminal fittings arranged in rows, the terminal fitting attaching an electric wire thereto;

a holding part including a molded member molded integrally with an outer periphery of at least one said electric wire; and a sealing member attached to an outer periphery of the holding part and sealing up a space between the holding part and the connector housing.

2. The connector according to claim 1, wherein the connector is provided with a plurality of the molded members, the molded members are molded integrally with outer peripheries of a plurality of the electric wires, and the molded members are placed one upon another.

3. The connector according to claim 2, wherein the holding part includes a molded layer molded integrally with a plurality of the molded members placed one upon another.

4. The connector according to claim 2, wherein the sealing member includes:

an outer periphery attached part attached to outer peripheries of a plurality of the molded members placed one upon another; and sandwiched parts sandwiched between a plurality of the molded members placed one upon another.

5. The connector according to claim 1, wherein the sealing member is formed when the space between the holding part and the connector housing is filled with synthetic resin on a condition that the holding part is received in the connector housing.

6. A connector comprising:

a connector housing receiving at least two terminal fittings arranged in rows, the terminal fitting attaching an electric wire thereto;

a holding part including a molded member molded integrally with an outer periphery of at least one said electric wire so as to form a unitary structure with part of the electric wire embedded in the molded member; and a sealing member attached to an outer periphery of the holding part and sealing up a space between the holding part and the connector housing.

* * * * *